US007188910B2

(12) United States Patent
Saito

(10) Patent No.: US 7,188,910 B2
(45) Date of Patent: Mar. 13, 2007

(54) CRUSHING STRUCTURE OF CRUSHER

(75) Inventor: Yoshitaka Saito, Kasuga (JP)

(73) Assignee: Hirado Kinzoku Kogyo Co., Ltd., Fukuoka (JP)

( * ) Notice: Subject to any disclaimer, the term of this patent is extended or adjusted under 35 U.S.C. 154(b) by 0 days.

(21) Appl. No.: 10/526,945

(22) PCT Filed: Feb. 28, 2003

(86) PCT No.: PCT/JP03/02402

§ 371 (c)(1),
(2), (4) Date: Mar. 8, 2005

(87) PCT Pub. No.: WO2004/024332

PCT Pub. Date: Mar. 25, 2004

(65) Prior Publication Data

US 2006/0152066 A1 Jul. 13, 2006

(30) Foreign Application Priority Data

Sep. 10, 2002 (JP) ..... 2002-264740

(51) Int. Cl.
*E21C 37/02* (2006.01)

(52) U.S. Cl. ..... 299/23

(58) Field of Classification Search ..... 299/20–23
See application file for complete search history.

(56) References Cited

U.S. PATENT DOCUMENTS 6,948,573 B2 * 9/2005 China et al. ..... 175/269

FOREIGN PATENT DOCUMENTS

| | | |
|---|---|---|
| GB | 1065361 | 4/1967 |
| JP | 49-35442 | 9/1974 |
| JP | 60-165591 | 11/1985 |
| JP | 3-57553 | 3/1991 |
| JP | 4-70389 | 6/1992 |
| JP | 2002-266587 | 9/2002 |

* cited by examiner

*Primary Examiner*—Sunil Singh
(74) *Attorney, Agent, or Firm*—Jordan and Hamburg LLP

(57) ABSTRACT

A conventional crusher forms a hollow space between paralleled straight portions of a wedge body portion and inner side surfaces of expanding members at the time of performing an expanding operation and hence, an expanding force of tapered portions of the wedge is not transmitted to the whole expanding members whereby the force is dispersed and a large crushing force cannot be obtained.

Accordingly, the crusher of the present invention comprises left and right expanding members for crushing, a wedge which is held between the left and right expanding members and expand the left and right expanding members, and a hydraulic cylinder which advances and retracts the wedge, wherein a sector connection portion is formed on a proximal end portion of the wedge, a spearhead-like tip-end expanding portion having a spearhead-shaped tip end is formed on a distal end thereof, spearhead-like intermediate expanding portions having a spearhead shape are formed on an upstream side of the tip-end expanding portion, both side surfaces of the connection portion, tip-end expanding portions, and the intermediate expanding portions are formed in a tapered surface with a same angle, and tapered surfaces of the same shape as the tapered surfaces of the wedge are formed on the inner surfaces of the left and right expanding members.

5 Claims, 3 Drawing Sheets

CRUSHING STRUCTURE OF CRUSHER

TECHNICAL FIELD

The present invention relates to the crushing structure of a crusher.

BACKGROUND ART

Conventionally, in splitting a stone, a large number of boring holes are formed in a surface of the stone along the stone splitting direction, expanding members which are mounted on a distal end of a crusher are inserted into the respective holes so as to expand the boring holes in the lateral direction whereby the stone is cracked from the inside thus splitting the stone. Such a crusher is configured to perform the crushing operation in a state that left and right expanding members are mounted on a lower portion of a hydraulic cylinder in a state that the expanding members are expandable in the lateral direction, and a wedge which is arranged between the expanding members is downwardly moved by a piston rod of the cylinder thus expanding the expanding members.

Here, in the crushing structure of the left and right expanding members of the crusher, tapered surfaces are formed on the wedge toward the distal end direction from a proximal end portion, a wedge body portion having a parallel straight shape is arranged between respective tapered portions, and tapered surfaces which are equal to the tapered surfaces formed on distal end portions of the wedge are formed on inner surfaces of distal end portions of the left and right expanding members which sandwich both sides of the wedge.

Accordingly, when the wedge is lowered due to the hydraulic cylinder, the tapered surfaces of the wedge expand the left and right expanding members outwardly thus forcibly expanding the boring hole formed in the stone so as to perform the stone splitting (see Japanese Patent Laid-open Hei3 (1991)-57553).

However, the conventional crushing structure of the crusher has following drawbacks.

That is, the crusher forms the tapered surfaces which are spearheaded toward the distal end portion and have the same inclination on a proximal end portion and a distal end portion of the wedge, the distal end portions of the left and right expanding members form the tapered surfaces having the same shape as the tapered surfaces of the distal end portions of the wedge, and the expanding members are expanded by the elevation and the lowering of the wedge. Accordingly, in splitting the stone, a large number of boring holes are formed in a large stone at a fixed interval on a straight line, the expanding members mounted on the distal end of the crusher are inserted, and the wedges are downwardly moved thus collectively performing the expansion of the left and right expanding members whereby the stone is split. In such a stone splitting operation, however, at the time of expanding the expanding members, a hollow space is formed between the paralleled straight portions of the wedge body portion and inner surfaces of the expanding members and hence, the expanding force of the tapered portion of the wedge is not transmitted to the whole expanding members, that is, the expanding force is dispersed thus giving rise to a drawback that a large crushing force cannot be obtained.

DISCLOSURE OF THE INVENTION

Accordingly, the present invention provides the crushing structure of a crusher which includes left and right expanding members for crushing, a wedge body which is sandwiched between left and right expanding members and expands the expanding members, and a hydraulic cylinder which reciprocates the wedge body, wherein outer side surfaces of the wedge body which perform a wedging function are formed of a wedge shape in plural stages, wedges of respective stages have tapered surfaces of an equal angle, and tapered surfaces having a shape which corresponds to the respective tapered surfaces of the wedge body are formed on inner side surfaces of the left and right expanding members.

Further, the present invention is also characterized by a following constitution.

A plurality of intermediate expanding portions are formed between a connecting portion of a proximal end portion and a tip-end expanding portion of the wedge and, at the same time, tapered surfaces which correspond to tapered surfaces of the plurality of intermediate expanding portions are formed on the inner side surfaces of the left and right expanding members.

BEST MODE FOR CARRYING OUT THE INVENTION

The crushing structure of a crusher according to the present invention interposes a wedge between left and right expanding members, operates the left and right expanding members so as to expand the left and right expanding members in the lateral direction corresponding to the elevating and lowering of the wedge, and splits a stone by cracking the stone from the inside thereof by making use of an expanding force of the left and right expanding members. Particularly, in expanding the left and right expanding members by making use of both tapered side surfaces of a connecting portion of the wedge, both tapered side surfaces of a tip-end expanding portion and both tapered side surfaces of an intermediate expanding portion particularly along with the elevation or lowering of the wedge, since both tapered side surfaces of the connecting portion, both tapered side surfaces of the tip-end expanding portion and both tapered side surfaces of the intermediate expanding portion are respectively formed into a tapered surface having an equal angle, tapered surfaces formed on inner side surfaces of the left and right expanding members which preliminarily form the inner side surfaces at an equal angle are expanded while being in contact with the tapered surfaces formed on outer side surfaces of the wedge as much as possible. Accordingly, compared to the conventional expanding members which form only the distal end portions into a tapered surface, the respective tapered surfaces can ensure the wide contact areas. Accordingly, the crushing structure exhibits the excellent advantageous effects with respect to the strength, the diffusion of an expanding force, the expansion stress and the like. In this manner, the present invention can simultaneously expand three portions of both expanding members at the same angle by making use of the respected tapered surfaces in at least three stages which are formed on the wedge vertically, whereby it is possible to carry out the crushing operation without lowering the crushing function.

An embodiment of the present invention is explained in detail in conjunction with attached drawings.

Figure 1:
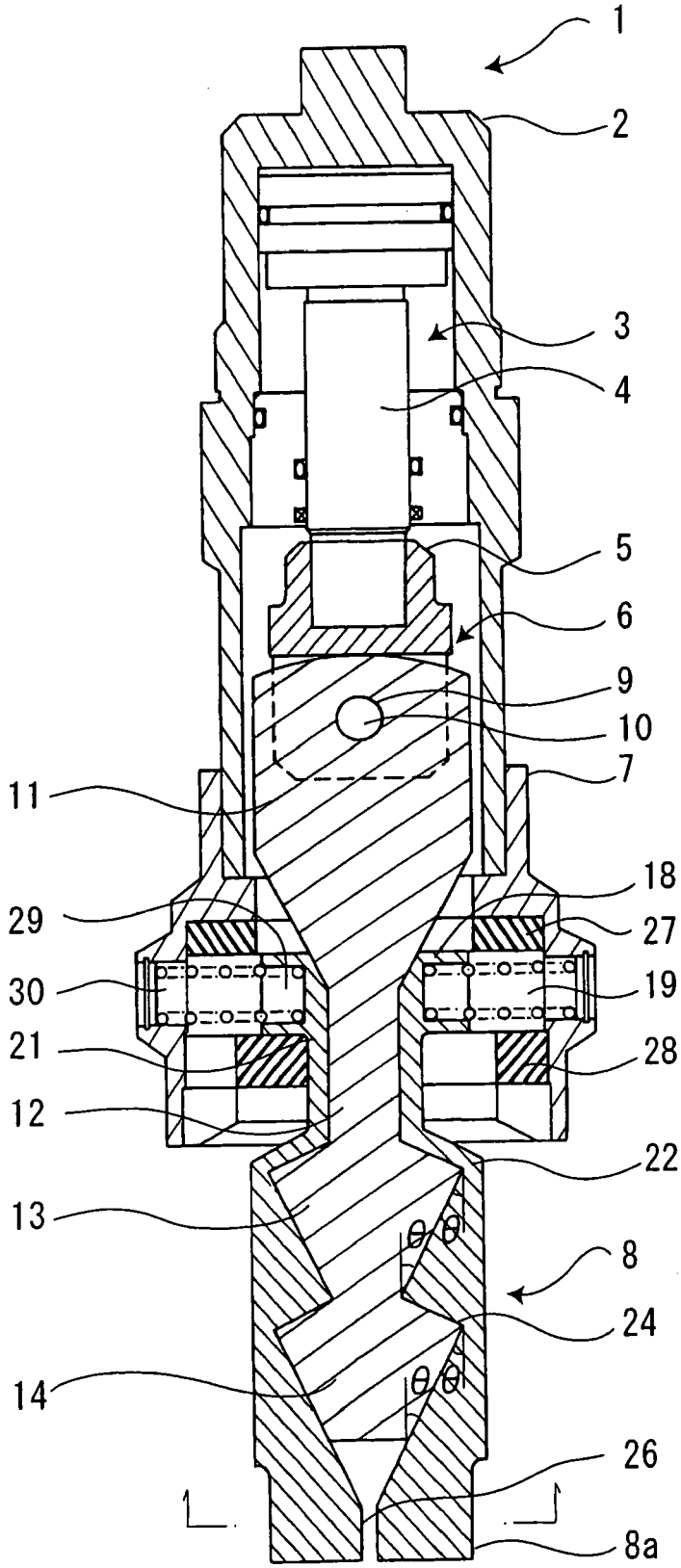
FIG. 1 is a front cross-sectional view of a crusher which utilizes the crushing structure of the present invention when the crusher is in a closed state.
Figure 2:
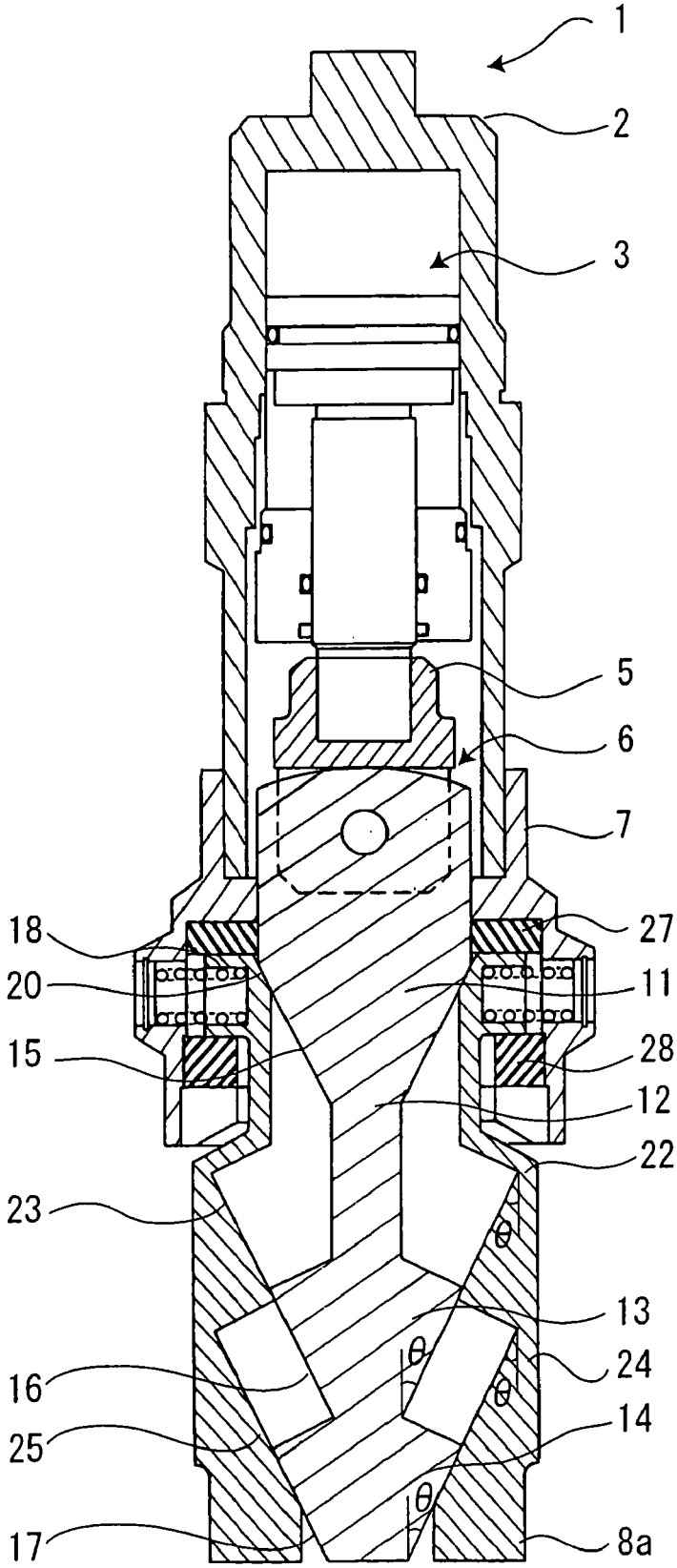
FIG. 2 is a front cross-sectional view of the crusher which utilizes the crushing structure of the present invention when the crusher is in an expanded state.

In FIG. 1 and FIG. 2, numeral 1 indicates a crusher to which the crushing structure of a crusher of the present invention is applied. The crusher 1 includes a cylindrical first frame 2, a hydraulic cylinder 3 which is mounted in the inside of the cylindrical first frame 2, a wedge 6 which is connected to a lower end portion of a rod 4 of the hydraulic cylinder 3 by way of a connecting fitting 5, a skirt-like second frame 7 which is mounted on an end portion of the first frame 2, and left and right expanding members 8, 8 having an approximately semi-circular cross sectional shape which has head portions thereof arranged in the inside of the second frame 7 and interposes the wedge 6 therebetween.

A connecting hole 9 is formed in an upper portion of the wedge 6. The wedge 6 and the rod 4 are integrally connected with each other by forming the above-mentioned connecting fitting 5 by way of a pin 10 which is inserted into the connecting hole 9.

The wedge 6 is formed into a planar shape which has a thickness substantially equal to a length of chords of the left and right expanding members 8, 8 having an approximately semicircular cross sectional shape. Further, an inversely-trapezoidal sector connection portion 11 which has an upper end surface thereof formed into a convex curved surface is formed on an uppermost portion thereof. On both side surfaces of a lower portion of the sector connection portion 11, connection-portion tapered surfaces 15 having an angle θ are formed. On lower end peripheries of the tapered surfaces 15, a wedge body portion 12 having a small width is integrally formed in a state that the wedge body portion 12 extends downwardly.

Further, an intermediate expanding portion 13 are formed on a lower end portion of the wedge body portion 12. Spearhead-like intermediate expanding portion tapered surfaces 16, 16 having an angle θ are formed on both side surfaces of the intermediate expanding portion 13. Further, a tip-end expanding portion 14 is formed on a lowermost end portion of the wedge 6. Spearhead-like tip-end expanding portion tapered surfaces 17, 17 having an angle θ are formed on both side surfaces of the tip-end expanding portion 14.

Next, the left and right expanding members 8, 8 which are arranged to be brought into contact with the left and right side surfaces of the wedge 6 are explained.

The inner side surfaces of the left and right expanding members 8, 8 are formed into a shape which corresponds to the respective tapered surfaces of the above-mentioned wedge 6. That is, expanding member supporting portions 18, 18 are positioned at heads of the left and right expanding members 8, 8 and cylindrical expanding member spring mounting holes 29, 29 which receive springs 19, 19 are formed in upper-end outer side surfaces of the expanding member supporting portions 18, 18. Further, upper end peripheries of the inner side surfaces of the expanding member supporting portions 18, 18 are formed into a tapered shape having an angle θ thus forming expanding-member-support-portion tapered surfaces 20, 20. Further, on inner side surface portions which are positioned below the expanding-member-support-portion tapered surfaces 20, 20, vertical surfaces 21, 21 which are contiguous with the expanding-member-support-portion tapered surfaces 20, 20 are formed. Further, on inner side surface portions which are positioned below the vertical surfaces 21, 21, intermediate receiving portions 22, 22 which correspond to intermediate expanding portions 13, 13 are formed. Side surface portions which are positioned below the intermediate receiving portions 22, 22 are formed into a tapered shape having an angle θ which corresponds to intermediate expanding portion tapered surfaces 16, 16 thus forming expanding member intermediate tapered surfaces 23, 23. Further, on inner side surface portions which are positioned below the expanding member intermediate tapered surfaces 23, 23, tip-end receiving portions 24, 24 which correspond to tip-end expanding portions 14, 14 are formed. On side surface portions which are positioned below the tip-end receiving portions 24, 24, expanding member tip-end tapered surfaces 25, 25 which are formed into a tapered shape having an angle θ which corresponds to the tip-end expanding portion tapered surfaces 17, 17 are formed. Further, inner side surface portions which are positioned below the expanding member tip-end tapered surfaces 25, 25, tip-end vertical surfaces 26, 26 which are contiguous with the expanding member tip-end tapered surfaces 25, 25 are formed.

Further, respective shoulder portions of the intermediate expanding portion 13 and the tip-end expanding portion 14, that is, upper-end surfaces of the respective expanding portions 13, 14 and respective shoulder portions of the intermediate receiving portions 22, 22 and the tip-end receiving portions 24, 24 of the left and right expanding members 8, 8, that is, upper-end receiving surfaces of the respective receiving portions 8, 8, 24, 24 respectively form corresponding inclined surfaces having a downward gradient or inclination.

Accordingly, when the wedge 6 is lowered to perform the expanding operation and, thereafter, is elevated to be restored to the original position of the left and right expanding members 8, 8, due to the inclined surfaces, an impact which is generated at the time of vertical elevation of the wedge 6, that is, an impact which is generated when an upper end surface of the expanding portion of the wedge 6 and upper-end receiving surfaces of the left and right expanding members 8, 8 come into contact with each other is not turned into a vertical upward pushing force against the left and right expanding members 8, 8 but is dispersed in the oblique direction due to the stress dispersion. Accordingly, it is possible to alleviate an impact applied to left and right expanding members 8, 8 whereby it is possible to perform the smooth expanding and contracting operation of the left and right expanding members 8, 8.

Figure 3:
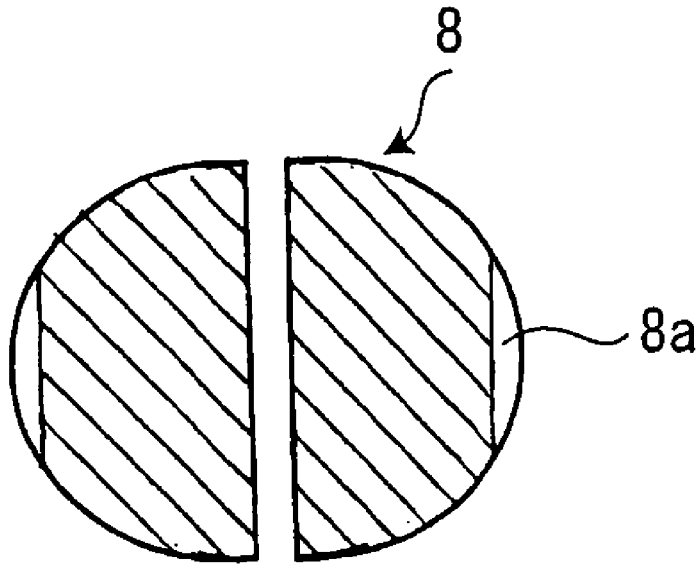
FIG. 3 is a cross-sectional view of lower end portions of the expanding members of the crushing structure of the present invention.

Further, as shown in FIG. 3, top portions of outer peripheral portions of lower ends of the left and right expanding members 8, 8 are partially cut to form flat contact portions 8*a*, 8*a*. Due to such a constitution, when the left and right expanding members 8, 8 are brought into contact with an object to be crushed, these flat contact portions 8*a*, 8*a* are brought into contact with the object to be crushed thus realizing the sufficient transmission of a crushing stress or force.

Further, On a lower end portion of the cylindrical first frame 2, a skirt-like second frame 7 is contiguously formed. In the inside of the second frame 7, a flange-like back plate 27 which supports the expanding member support portions 18, 18 of the left and right expanding members 8, 8 and a two-split flange-like guide plate 28 are mounted in the vertical direction. Here, in a flange-like inner hole portion of the guide plate 28, the expanding member support portions 18, 18 of the left and right expanding members 8, 8 penetrate.

That is, above the expanding member support portions 18, 18 of the left and right expanding members 8, 8, the flange-like back plate 27 which receives upper end surfaces of the left and right expanding members 8, 8 are arranged and, at the same time, below the expanding member support portions 18, 18 of the left and right expanding members 8, 8, the two-split flange-like guide plate 28 is arranged in a state that the guide plate 28 is brought into contact with the support portions 18, 18.

When the left and right expanding members 8, 8 are opened or closed corresponding to the elevating and lowering operation of the wedge 6, the left and right expanding member support portions 18, 18 which are formed on the heads of the left and right expanding members 8, 8 in a projecting manner are slidably brought into contact with an upper surface of the guide plate 28 and are guided by the guide plate 28.

Further, between the expanding member spring mounting holes 29, 29 formed in the outer side surfaces of the expanding member support portions 18, 18 of the left and right expanding members 8, 8 and second frame spring mounting holes 30, 30 which are formed in an inner portion of the skirt-like second frame 7, springs 19, 19 are interposed thus biasing the left and right expanding members 8, 8 in the inside direction.

Accordingly, when the left and right expanding members 8, 8 are closed due to the biasing force of the springs 19, 19, the respective tapered surfaces 20, 23, 25, 20, 23, 25 which are formed on both inner side surfaces of the left and right expanding members 8, 8 are brought into close contact with the respective tapered surfaces 15, 16, 17, 15, 16, 17 formed on the outer side surfaces of the wedge 6.

Further, the wedge 6 having the above-mentioned constitution is configured to open or close the left and right expanding members 8, 8 by way of the respective tapered surfaces due to the elevating and lowering operation of the wedge 6. Here, on the upper end portions of the left and right expanding members 8, 8, the wedge body portion 12 of the wedge 6 is arranged in a sandwiched state and, at the same time, the inverse-trapezoidal connecting portion 11 formed on the upper portion of the wedge 6 is assembled in a state that the connecting portion 11 projects upwardly from the left and right expanding members 8, 8.

Further, as shown in FIG. 2, when both connecting-portion tapered side surfaces 15, 15 of the wedge 6 are positioned above both expanding-member support portion tapered side surfaces 20, 20 which are formed on the inner side surfaces of the left and right expanding members 8, 8, along with the lowering of the wedge 6 caused by the lowering operation of the hydraulic cylinder 3, due to a pressing force from the connecting-portion tapered side surfaces 15, 15, the intermediate expanding portion tapered surfaces 16, 16, the tip-end expanding tapered surfaces 17, 17 and the like which are formed on both left and right side surfaces of the wedge 6, the expanding-member support portion tapered side surfaces 20, 20, the expanding-member intermediate tapered surfaces 23, 23, the expanding-member tip-end tapered surfaces 25, 25 and the like are expanded.

That is, since all of the respective tapered surfaces 15, 16, 17, 15, 16, 17 which are formed on both side surfaces of the wedge 6 and the respective tapered surfaces 20, 23, 25, 20, 23, 25 which are formed on both inner side surfaces of the left and right expanding members 8, 8 have the same angle θ, due to a wedge action, the left and right expanding members 8, 8 are expanded in parallel in the left and right directions.

Although the embodiment of the present invention is configured and is operated in the above-mentioned manner, particularly, while the inner side surfaces of the left and right expanding members 8, 8 and the outer side surfaces of the wedge 6 are held in the close contact state in an initial stage of the operation, due to the lowering operation of the wedge 6, tapered surfaces formed on both outer side surfaces of the wedge 6 expand the tapered surfaces formed on inner side surfaces of the left and right expanding members 8, 8 in the left and right directions due to the wedge action. Here, since the contact portion of tapered surfaces of the wedge 6 and the left and right expanding members 8, 8 takes place not only at the upper end portion and the lower end portion but also at the intermediate portion and hence, the expanding stress or force of the intermediate portion of the left and right expanding members 8, 8 is sufficiently transmitted. Further, gap between the wedge 6 and the left and right expanding members 8, 8 can be reduced as much as possible and hence, the reduction of the strength of the left and right expanding members 8, 8 can be also prevented.

Further, different from the conventional constitution which forms the contact tapered surfaces between the wedge 6 and the left and right expanding members 8, 8 wholly and integrally over the upper and lower ends, since the respective portions, that is, the upper end portion, the intermediate portion and the lower end portion of the wedge 6 and the left and right expanding members 8, 8 are formed with the same taper angle, it is possible to set the left-and-right expanding width of the left and right expanding members 8, 8 to a fixed desired value while making the widths of the wedge 6 and the left and right expanding members 8, 8 as compact as possible. Accordingly, even when the elevating and lowering range of the wedge 6 is set equal to a range of the previously-mentioned conventional constitution, it is possible to constitute the whole device in a compact form. Further, it is possible to ensure the sufficient expanding width and the sufficient expanding stress or force.

Further, as another embodiment, there may be considered that by forming a plurality of intermediate expanding portions 13 between the connecting portion 11 and the tip-end expanding portion 14 of the wedge 6, compared to the crusher 1 of the present invention which is provided with one intermediate expanding portion 13, the number of the intermediate expanding portions 13 is increased, all of a plurality of respective tapered surfaces formed on both side surfaces of the wedge 6 and the respective tapered surfaces of the plurality of intermediate portions 13 formed on both inner side surfaces of the left and right expanding members 8, 8 have the same angle θ, and the left and right expanding members 8, 8 and expanded in parallel in the left and right directions due to a wedge action. Particularly, since the plurality of intermediate expanding portions 13 are formed, it is possible to reduce the gap between the intermediate portion of the left and right expanding members 8, 8 and the wedge 6 as much as possible and hence, it is possible to transmit the expanding stress or force of the left and right expanding members 8, 8 to a contacting object as much as possible whereby the crushing efficiency is enhanced and, at the same time, the strength of the left and right expanding members 8, 8 is also reinforced.

Further, different from the conventional constitution which forms the contact tapered surfaces between the wedge 6 and the left and right expanding members 8, 8 wholly and integrally over the upper and lower ends, since the contact tapered surfaces are formed with the same taper angle at the plurality of portions, it is possible to set the left-and-right expanding width of the left and right expanding members 8, 8 to a fixed desired value while making the widths of the wedge 6 and the left and right expanding members 8, 8 as compact as possible. Accordingly, even when the elevating and lowering range of the wedge 6 is set equal to a range of the previously-mentioned conventional constitution, it is possible to constitute the whole device in a compact form. Further, it is possible to ensure the sufficient expanding width and the sufficient expanding stress or force.

INDUSTRIAL APPLICABILITY (1) According to the present invention described in the description, the crusher of the present invention comprises left and right expanding members for crushing, a wedge which is sandwiched between the left and right expanding members and expand the left and right expanding members, and a hydraulic cylinder which moves the wedge forward and backward, wherein an inverse-trapezoidal connecting portion is formed on a proximal end portion of the wedge, spearhead-like tip-end expanding portions having a spearhead-shaped tip end are formed on a distal end thereof, spearhead-like intermediate expanding portions having a spearhead shape are formed on an upstream side of the tip-end expanding portions, both side surfaces of the connection portion, tip-end expanding portions, and the intermediate expanding portions are formed in a tapered surface with the same angle, and a tapered surface of the same shape as the tapered surface of the wedge is formed on the inner surfaces of the left and right expanding members.

Accordingly, due to the lowering operation of the wedge, the respective both tapered side surfaces of the wedge in three stages having the same angle expand the respective both tapered inner side surfaces of the left and right expanding members in three stages having the same angle and hence, the proximal portion and the distal end portion of the left and right expanding members can be simultaneously expanded with the same expanding width. Accordingly, the crusher of the present invention can, irrelevant to the opening or closing of the left and right expanding members, can support the tapered surfaces at three respective portions of the expanding members using the tapered surfaces at three portions of the wedge and hence, the contact area of the respective tapered surfaces is increased compared to the expanding members which have the tapered surface only at the distal end portion whereby the crusher exhibits the excellent property in the strength, the dispersion of the expansion, the expanding stress or force and the like thus generating the large crushing force.

Further, since the contact tapered surfaces between the wedge and the left and right expanding members are formed at the respective portions consisting of the upper end portion, the intermediate portion and the lower end portion with the same taper angle, it is possible to set the left-and-right expanding width of the left and right expanding members to a fixed desired width while maintaining the widths of the wedge and the left and right expanding members as compact as possible. Accordingly, it is possible to prevent the increase of the width of the wedge, the increase of the elevation range of the wedge, the increase of the width of the expanding members and the enlargement of the device attributed to the increase of the width of the expanding members thus constituting the whole device in a compact form.

(2) According to the present invention described in the description, a plurality of intermediate expanding portions are formed between a connecting portion of a wedge proximal end portion and a tip-end expanding portion and, at the same time, tapered surfaces which correspond to tapered surfaces of the plurality of intermediate expanding portions are formed on the inner side surfaces of the left and right expanding members.

Accordingly, due to the lowering operation of the wedge, the plurality of respective both tapered side surfaces of the wedge having the same angle expand the plurality of respective both tapered inner side surfaces of the left and right expanding members having the same angle and hence, the proximal portion and the distal end portion of the left and right expanding members can be simultaneously expanded with the same expanding width. Accordingly, the crusher of the present invention can, irrelevant to the opening or closing of the left and right expanding members, can support the plurality of tapered surfaces formed on both inner side surfaces of the expanding members using the plurality of tapered surfaces formed on both side surfaces of the wedge and hence, the contact area of the respective tapered surfaces is increased compared to the expanding members which have the tapered surface only at the distal end portion whereby the crusher exhibits the excellent property in the strength, the dispersion of the expansion, the expanding stress or force and the like thus generating the large crushing force.

Further, since the contact tapered surfaces between the wedge and the left and right expanding members are formed at the plurality of portions with the same taper angle, it is possible to set the left-and-right expanding width of the left and right expanding members to a fixed desired width while maintaining the widths of the wedge and the left and right expanding members as compact as possible. Accordingly, it is possible to prevent the increase of the width of the wedge, the increase of the elevation range of the wedge, the increase of the width of the expanding members and the enlargement of the device attributed to the increase of the width of the expanding members thus constituting the whole device in a compact form.

The invention claimed is:

1. A crushing structure of a crusher comprising:

first and second expanding members for crushing;

a wedge which is sandwiched between said first and second expanding members and which expands said first and second expanding members away from each other;

springs; and a hydraulic cylinder which advances or retracts the wedge in a longitudinal direction, wherein said wedge comprises a connection portion, a wedge body support portion, and at least two wedge bodies depending from and supported by said wedge body support portion;

said connection portion connects said hydraulic cylinder to said wedge, said connection portion being integrally connected to said wedge body support portion;

said at least two wedge bodies are integrally connected to one another and one of said at least two wedge bodies is integrally connected to said wedge body support portion, each of said at least two wedge bodies having a wedge shape;

said connection portion has a trapezoidal shape portion with a decreasing width in said longitudinal direction, said trapezoidal shape portion being integrally connected to said wedge body support portion;

said wedge body support portion has a substantially constant width narrower than a width of said trapezoidal shape portion, said wedge body support portion extending in said longitudinal direction;

said trapezoidal shape portion forms first tapered surfaces, each of said first tapered surfaces defining a plane which forms a predetermined first angle with a line defined by said longitudinal direction;

each of said first and second expanding members has an expanding member support portion, each expanding member support portion having a second tapered surface configured to face a respective of said first tapered surfaces;

each of said second tapered surfaces defines a plane which forms a predetermined second angle with a line defined by said longitudinal direction, said predetermined second angle being the same as said predetermined first angle;

each of said first and second expanding members has a longitudinal surface extending in said longitudinal direction contiguously formed with a respective second tapered surface and said wedge body support portion is arranged between said longitudinal surfaces, said longitudinal surfaces being substantially parallel to each other;

said springs are arranged so as to bias said first and second expanding members in a direction towards said wedge so as to transmit a biasing force to said wedge through each of said longitudinal surfaces;

each of said at least two wedge bodies has a third tapered surface and each of said third tapered surfaces defining a plane which forms a predetermined third angle with a line defined by said longitudinal direction, said predetermined third angle being the same as said predetermined first angle;

each of said first and second expanding members has fourth tapered surfaces which correspond to each of said third tapered surfaces and said fourth tapered surfaces are formed on respective inner side surfaces of said first and second expanding members and each of said fourth tapered surfaces define a plane which forms a predetermined fourth angle with a line defined by said longitudinal direction, said predetermined fourth angle being the same as said predetermined first angle.

2. A crushing structure of a crusher according to claim 1, wherein said at least two wedge bodies comprise a plurality of intermediate expanding portions formed between said wedge body support portion and a tip-end expanding portion.

3. A crushing structure of a crusher according to claim 1, wherein said wedge comprises planar surfaces.

4. A crushing structure of a crusher according to claim 1, wherein said springs comprise helical springs having an axis substantially perpendicular to said longitudinal direction.

5. A crushing structure of a crusher according to claim 1, wherein each of said at least two wedge bodies comprises inclined fifth surfaces on shoulder portions of each of said wedge bodies; and each of said first and second expanding members have sixth inner surfaces which correspond to each of said fifth surfaces.

* * * * *